US005100586A

United States Patent [19]

Jennings et al.

[11] Patent Number: 5,100,586

[45] Date of Patent: Mar. 31, 1992

[54] CEMENTITIOUS HAZARDOUS WASTE CONTAINERS AND THEIR METHOD OF MANUFACTURE

[75] Inventors: Hamlin M. Jennings, Evanston, Ill.; Simon K. Hodson, Santa Barbara, Calif.

[73] Assignee: E. Khashoggi Industries, Santa Barbara, Calif.

[21] Appl. No.: 556,086

[22] Filed: Jul. 20, 1990

[51] Int. Cl.[5] ..... G21F 9/16; G21F 9/34

[52] U.S. Cl. ..... 252/629; 252/625; 52/310

[58] Field of Search ..... 252/625, 626, 627, 628, 252/629

[56] References Cited

U.S. PATENT DOCUMENTS

| | | | |
|---|---|---|---|
| 3,468,993 | 9/1969 | Bierlich | 264/82 |
| 3,526,172 | 9/1970 | Stuart | 94/25 |
| 3,749,917 | 7/1973 | Kucherer | 250/108 |
| 3,950,470 | 4/1976 | Davidovits | 264/113 |
| 3,983,050 | 9/1976 | Mecham | 252/301.1 |
| 3,985,925 | 10/1976 | Lefebvre et al. | 428/92 |
| 4,000,027 | 12/1976 | Dalle et al. | 156/73.6 |
| 4,017,417 | 4/1977 | Clark et al. | 252/301.1 |
| 4,028,454 | 6/1977 | Davidovits et al. | 264/82 |
| 4,222,889 | 9/1980 | Uerpmann | 252/301.1 |
| 4,257,912 | 3/1981 | Fleischer et al. | 252/301.1 |
| 4,299,722 | 11/1981 | Stuck et al. | 252/628 |
| 4,349,386 | 9/1982 | Davidovits | 106/85 |
| 4,452,635 | 6/1984 | Noshi et al. | 106/74 |
| 4,472,199 | 9/1984 | Davidovits | 106/85 |
| 4,509,985 | 4/1985 | Davidovits et al. | 106/84 |
| 4,518,508 | 5/1985 | Conner | 210/751 |
| 4,522,652 | 6/1985 | Neuschäeffer et al. | 106/84 |
| 4,533,393 | 8/1985 | Neuschäeffer et al. | 106/18.12 |
| 4,581,162 | 4/1986 | Kawamura et al. | 252/628 |
| 4,608,795 | 9/1986 | Neuschäeffer et al. | 52/309.12 |
| 4,640,715 | 2/1987 | Heitzmann et al. | 106/85 |
| 4,642,137 | 2/1987 | Heitzmann et al. | 106/85 |
| 4,642,204 | 2/1987 | Burström et al. | 252/633 |
| 4,652,404 | 3/1987 | Mallek et al. | 252/628 |
| 4,681,631 | 7/1987 | Engels et al. | 106/4 |
| 4,708,822 | 11/1987 | Fukasawa et al. | 252/628 |
| 4,834,917 | 5/1989 | Ramm et al. | 252/633 |
| 4,859,367 | 8/1989 | Davidovits | 252/628 |
| 4,888,311 | 12/1989 | Davidovits et al. | 501/95 |
| 4,904,416 | 2/1990 | Sudo et al. | 252/628 |

FOREIGN PATENT DOCUMENTS

| | | |
|---|---|---|
| 35125145A1 | 10/1986 | Fed. Rep. of Germany . |
| 181745 | 6/1922 | United Kingdom . |
| 366544 | 2/1932 | United Kingdom . |
| 431484 | 7/1935 | United Kingdom . |
| 453555 | 9/1936 | United Kingdom . |

OTHER PUBLICATIONS

Research and Development on Radioactive Waste Management and Storage, Annual Progress Report 1982 of the European Community Programme 1980–1984, Hardwood Academic Publishers, 1983.

J. M. Bukowski et al., "Radioactivity and Strength Development of $CO_2$ Activated Non-Hydraulic Calcium Silicates", *Cement and Concrete Research,* vol. 9, pp. 57–68, 1979.

(List continued on next page.)

*Primary Examiner*—Brooks H. Hunt
*Assistant Examiner*—Daniel J. Jenkins
*Attorney, Agent, or Firm*—Workman, Nydegger & Jensen

[57] ABSTRACT

Novel cementitious containers for storage of hazardous waste are disclosed having an inner layer of substantially unhydrated cement in contact with the hazardous waste and an outer layer of hydrated cement. Cementitious hazardous waste containers may be prepared by compressing powdered hydraulic cement around solid hazardous waste materials and then hydrating an outer layer of the powdered hydraulic cement. An inner layer of powdered hydraulic cement remains unhydrated and capable of reacting with any water which might breach the outer layer or originate with the hazardous waste itself. The inner layer of powdered hydraulic cement is also capable of reacting with any carbon dioxide or carbon monoxide generated by decomposition of organic waste materials.

58 Claims, 1 Drawing Sheet

OTHER PUBLICATIONS

R. F. Feldman et al., "A Study of Length Changes of Compacts of Portland Cement on Exposure to $H_2O$", Paper sponsored by Committee on Basic Research Pertaining to Portland Cement and Concrete, pp. 106–118.

Jan Hlavac, "The Technology of Glass and Ceramics–An Introduction", *Glass Science and Technology,* 4, 1983.

J. T. Jones et al., "Ceramics Industrial Processing and Testing", *The Iowa State University Press,* pp. 20–61, 1972.

C. D. Lawrence, "The Properties of Cement Paste Compacted Under High Pressure", *London, Cement and Concrete Association,* Research Report 19, p. 21, Jun. 1969.

J. Norman Maycock et al., "Carbonation of Hydrated Calcium Silicates", *Cement and Concrete Research,* vol. 4, pp. 69–76, 1974.

J. Skalny et al., "Low Water To Cement Ratio Concretes", *Cement and Concrete Research,* vol. 3, pp. 29–40, 1973.

Katzutaka Suzuki et al., "Formation and Carbonation of C–S–H In Water", *Cement and Concrete Research,* vol. 15, pp. 213–224, 1985.

Report on the Panel on Solids Processing, Chapter 2, pp. 18–43.

J. I. Duffy, "Treatment, Recovery, and Disposal Processes for Radioactive Waste: Recent Advances," Noyes Data Corporation, pp. 74–77, 1983.

CEMENTITIOUS HAZARDOUS WASTE CONTAINERS AND THEIR METHOD OF MANUFACTURE

BACKGROUND

1. The Field of the Invention

The present invention relates to containers for storage of solid hazardous waste materials. More particularly, the present invention is directed to containers prepared from cementitious materials capable of long-term safe storage of certain highly toxic and nuclear waste materials.

2. Technology Review

In recent years, the public has become more sensitive to the environment and the effect of hazardous and toxic waste materials on the environmental ecosystem. Nuclear waste materials are some of the most dangerous toxic wastes because they can remain radioactive for extremely long periods of time. There is, therefore, a serious need for effective longterm storage containers for nuclear and other hazardous waste materials.

Much of the nuclear waste materials which needs to be disposed of includes refuse from nuclear weapons plants, civilian power plants, and medical industry sources. Unlike spent fuel rods which decay by emitting high level gamma radiation, the plutonium waste from weapons plants decays by penetrate paper. As a result, the plutonium waste materials from weapons plants may be handled without protective clothing and pose no danger, as long as they remain sealed. Nevertheless, plutonium is extremely toxic and very long-lived lived. In addition, it is estimated that sixty percent (60%) of the plutonium-contaminated waste from weapons plants is also tainted with hazardous chemicals such as industrial solvents.

Gloves, shoes, uniforms, tools, floor sweepings, and sludge contaminated with radioactive materials while manufacturing nuclear warheads are typically contained in 55 gallon steel drums. The Waste Isolation Pilot Project ("WIPP") site near Carlsbad, N.M., is one possible disposal site for such waste materials. The WIPP site was excavated in a massive underground salt formation. Underground salt formations, such as the WIPP site, are considered as possible permanent nuclear waste disposal sites because of the long-term stability of the underground formation and because salt has a low water permeability.

In one possible disposal plan using underground disposal sites for low-level nuclear waste materials, the underground rooms are filled with the waste containers and back-filled with a grout material to fill as much empty space as possible During the first 100 years, the underground storage rooms would collapse and crush the waste containers.

One problem with conventional 55 gallon steel drums is Eventually, the drums will be crushed when the storage room collapses; however, the presence of empty spaces permits ground water to seep into the cavities which can cause corrosion of the steel drum and decomposition of organic waste materials. Since the disposal site is not completely sealed until the underground storage room collapses and fills all void spaces, rapid collapse of the storage room is desirable so that the disposal site is sealed quickly.

Another disadvantage of conventional 55 gallon steel drums is that they are potentially capable of undergoing corrosion which would produce gases, especially $H_2$, and which may lead to high pressure bubbles. Corrosion and its related gas evolution are considered long term liabilities. Corrosion is caused by groundwater, usually containing high concentrations of dissolved ions (i.e., 1 to 2 molar). If the hazardous waste includes organic materials, such as contaminated rubber and certain waste solvents, carbon dioxide gas may be produced which may also lead to high pressure bubbles.

Only recently has the need to avoid formation of the so-called high pressure bubbles been recognized. Current government regulations of long-term hazardous waste storage sites assume that at some time over the storage lifetime, the storage medium will be breached by underground drilling devices. If high pressure bubbles exist at the location where the storage medium is breached, then it is possible that contaminated materials may be inadvertently released under pressure.

An ideal solid hazardous waste container should satisfy some of the following characteristics: (1) the container should be made of a nonmetal or other material which intrinsically does not corrode and produce gases; (2) the container should be inexpensive; (3) the container should be impermeable to water and, if water does penetrate the container, it should act as an $H_2O$ getter, i.e.. it should combine with water to form an insoluble solid; (4) the container should have $CO_2$ getter characteristics, i.e., it should react with $CO_2$ to form a solid; and (5) the container should be of a material which expands if for any reason aqueous solution does breach the impermeable outer layer. Expansion of the material on contact with water seals and fills any cracks in the container wall and also fills any space between the storage container and the walls of the salt mine which collapse around the container.

From the foregoing, it will be appreciated that what is needed in the art are containers for storing solid hazardous waste which are constructed of nonmetal materials which do not intrinsically corrode to produce a gas.

Additionally, it would be a significant advancement in the art to provide containers for storing solid hazardous waste which are $H_2O$ and $CO_2$ getters.

It would be a further advancement in the art to provide containers for storing solid hazardous waste constructed of materials which expand upon contact with aqueous solution to fill holes and thereby inhibit further aqueous solution penetration into the container.

Finally, it would be an important advancement in the art to provide containers for solid hazardous waste which are inexpensive.

Such solid hazardous waste containers are disclosed and claimed herein.

BRIEF SUMMARY AND OBJECTS OF THE INVENTION

The present invention is directed to novel containers for storage of solid waste materials such as highly toxic and nuclear waste materials. More particularly, the present invention includes cementitious containers having a hydrated outer shell to provide mechanical strength and an unhydrated compressed inner layer in contact with the waste materials which is capable of reacting with any aqueous solution which may penetrate the outer shell or leak from the contained waste material.

The waste containers within the scope of the present invention are preferably prepared by surrounding solid hazardous waste with a layer of powdered hydraulic cement and then compressing the cement around the solid waste. The outer surface of the compressed hydraulic cement is then hydrated in order to close the pore structure and to provide mechanical strength. The amount of hydration may vary from a very nominal amount to extensive hydration depending upon the desired strength characteristics of the final waste container.

The term "solid hazardous waste" includes solid, substantially solid, and semisolid materials which may contain varying amounts of water. As used herein, the term "solid hazardous waste" includes hazardous waste materials typically contained in steel waste containers, with or without the waste container. In addition, the waste containers, which include conventional 55 gallon steel drums and other similar storage containers, may individually be included within the scope of the term "solid hazardous waste."

The present invention is directed to containers for solid hazardous waste, as opposed to liquid hazardous waste. Although there may be some liquid associated with the hazardous waste, the waste material is preferably substantially solid or semisolid. The water content of the solid hazardous waste may range from anhydrous waste materials to waste materials saturated with water. According to government regulations, the amount of free liquid associated with the waste is preferably less than about a pint per 55 gallon drum.

Hydraulic cements used within the scope of the present invention are inexpensive and do not produce gases. In some cases, more than one layer of powdered hydraulic cement may be used. For instance, an outer layer of Portland cement may surround an inner layer of expansive and fast reacting high alumina cement.

Pressure compaction processes, including isostatic compression, may be used to prepare the containers within the scope of the present invention. Pressures sufficient to compact the cement to densities in the range from about 1.5 $g/cm^3$ to about 3.2 $g/cm^3$.

Various techniques may be used to hydrate the compressed hydraulic cement. For instance, a compressed container may be hydrated by soaking it in an aqueous solution. The aqueous solution would diffuse into the container and hydrate the cement to an average depth in the range from about zero to several feet, and preferably in the range from about 0.25 inches to about 3 inches, depending on the exposure time.

In some cases, sufficient hydration may be obtained by exposure with $CO_2$ in a high relative humidity. Regardless of the extent of outer surface hydration, it is important that the inner powdered hydraulic cement remain in a substantially unhydrated state. If aqueous solution were to breach the outer layer, the unhydrated inner cement layer would be available to react with the water.

Importantly, if carbon dioxide happens to be produced through the decomposition of organic materials, then calcium hydroxide (one of the reaction products of the container) is available to react with carbon dioxide as a $CO_2$ getter. Of course, carbon dioxide would be produced only to the extent that water breaches the container and comes in contact with the waste material or if there is water in the waste material itself.

Because the hazardous waste containers are prepared by compressing the hazardous waste within a layer of powdered hydraulic cement, the void space within the container is minimized. The hazardous waste materials are essentially compacted to a high density inside a strong and stable container.

It is, therefore, an object of the present invention to provide novel containers for storing solid hazardous waste which are constructed of nonmetal materials which do not intrinsically corrode to produce a gas.

Another important object of the present invention is to provide novel containers for storing solid hazardous waste which are $H_2O$ and $CO_2$ getters.

Yet another important object of the present invention is to provide novel containers for storing solid hazardous waste constructed of materials which expand upon contact with aqueous solution to inhibit further aqueous solution penetration into the container.

An additional object of the present invention is to provide novel containers for solid hazardous waste which are inexpensive.

These and other objects and features of the present invention will become more fully apparent from the following description and appended claims, or may be learned by the practice of the invention.

BRIEF DESCRIPTION OF THE DRAWINGS

In order to more fully understand the manner in which the above-recited and other advantages and objects of the invention are obtained, a more particular description of the invention briefly described above will be rendered by reference to a specific embodiment thereof which is illustrated in the appended drawing. Understanding that this drawing depicts only a typical embodiment of the invention and is not, therefore, to be considered limiting in its scope, the invention will be described and explained with additional specificity and detail through the use of the accompanying drawing in which.

DETAILED DESCRIPTION OF THE PREFERRED EMBODIMENTS

Figure 1:
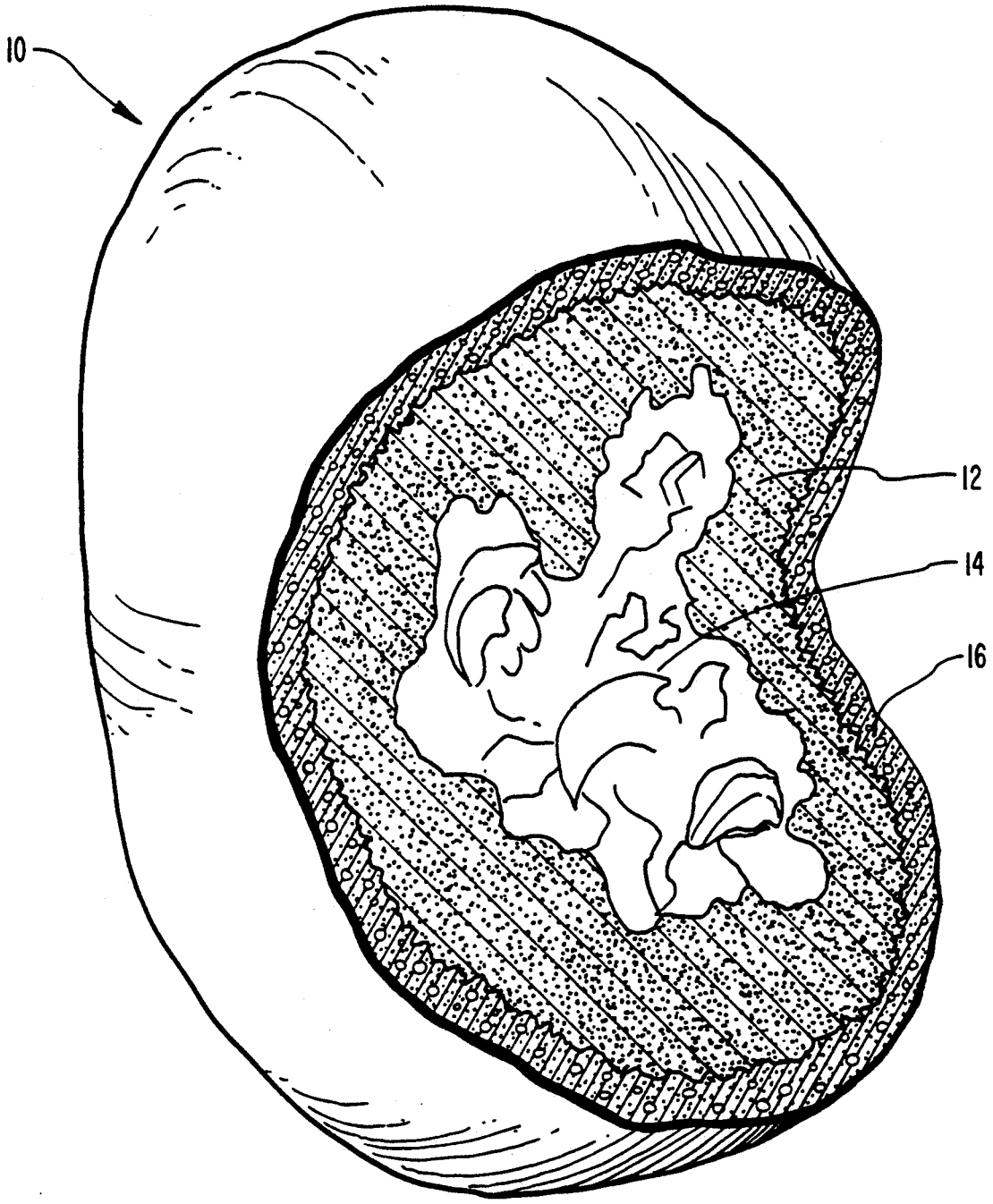
FIG. 1 is a partial cut-away perspective view of one hazardous waste container within the scope of the present invention.

The present invention provides novel cementitious containers for storage of solid hazardous waste. In general, the cementitious hazardous waste containers within the scope of the present invention include an inner layer of substantially unhydrated powdered hydraulic cement in contact with and compressed around the hazardous waste. An outer layer of hydrated cement is preferably included to add strength to the container.

Referring now to FIG. 1, one possible hazardous waste container within the scope of the present invention is illustrated. Hazardous waste container 10 is prepared by compressing substantially unhydrated powdered hydraulic cement 12 around solid hazardous waste 14, followed by hydrating outer surface layer 16 of the powdered hydraulic cement.

The average thickness of outer surface layer 16 may vary from as little as 0.001 inches to as much as 100 inches. In most cases, the thickness will range from about 0.25 inches to about 3 inches. Desired strength characteristics often dictate the thickness of the hydrated outer surface layer. In some cases, natural water vapor in the atmosphere may hydrate a thin outer surface layer prior to depositing the waste container in an underground storage site. More complete hydration would then occur over the years as ground water contacts the waste container.

Although the hazardous waste container shown in FIG. 1 is generally spherical in shape, it will be appreciated that the waste containers within the scope of the present invention may be prepared in a variety of different shapes. For instance, triangular, rectangular, hexagonal, and many other geometric cross-sectional configurations may be used. These cross-sectional configurations enable completed waste containers to be packed together more efficiently than cylindrical waste containers for tranportation and final storage of the waste containers.

Waste containers within the scope of the present invention may also be prepared by compressing powdered hydraulic cement around the solid hazardous waste and thereafter applying a layer of cement paste over the compressed powdered hydraulic cement. Aggregates may be added to the powdered hydraulic cement or to the cement paste to provide desired mechanical properties.

It is also within the scope of the present invention to compress a first layer of powdered hydraulic cement around a quantity of solid hazardous waste, hydrate the outer cement surface, compress another layer of the powdered hydraulic cement around the first layer, and then hydrate the outer cement surface. Any number of cement layers can be prepared in this manner. It is also possible to incorporate aggregates into one or more layers to obtain desired structural or mechanical characteristics.

Because the powdered hydraulic cement is compressed around the hazardous waste materials, the void space within the hazardous waste container is substantially reduced. The hazardous waste materials are essentially "precrushed" inside the container walls. In this pre-stabilized condition, the waste containers are much closer to equilibrium with the ground without the need for further compaction, grouting, or sealing.

In the case where the hazardous waste containers are buried in underground vaults, the fewer number of void spaces within the waste containers enables the ground to reach equilibrium high pressure faster when the underground storage room collapses. In addition, the problems with ground water seeping into void spaces are reduced.

Many of the general principles regarding pressure compaction of powdered hydraulic cement as well as various techniques for hydrating packed hydraulic cement are discussed in copending patent application Ser. No. 07/526,231, filed May 18, 1990, in the names of Hamlin M. Jennings and Simon K. Hodson and entitled "Hydraulically Bonded Cement Compositions and Their Methods of Manufacture and Use," which is incorporated herein by specific reference.

The family of cements known as hydraulic cements used in the present invention is characterized by the hydration products that form upon reaction with water. It is to be distinguished from other cements such as polymeric organic cements. The term powdered hydraulic cement, as used herein, includes clinker, crushed, ground, and milled clinker in various stages of pulverizing and in various particle sizes. The term powdered hydraulic cement also includes cement particles which may have water associated with the cement; however, the water content of the powdered hydraulic cement is preferably sufficiently low that the cement particles are not fluid. The water to cement ratio is typically less than about 0.20.

Examples of typical hydraulic cements known in the art include: the broad family of Portland cements (including ordinary Portland cement without gypsum), calcium aluminate cements (including calcium aluminate cements without set regulators, e.g., gypsum), plasters, silicate cements (including $\beta$ dicalcium silicates, tricalcium silicates, and mixtures thereof), gypsum cements, phosphate cements, and magnesium oxychloride cements.

Hydraulic cements generally have particle sizes ranging from 0.1 $\mu$m to 100 $\mu$m. The cement particles may be gap-graded and recombined to form bimodal, trimodal, or other polymodal systems to improve packing efficiency. For example, a trimodal system having a size ratio of 1:5:25 and a mass ratio of 21.6:9.2:69.2 (meaning that 21.6% of the particles, by weight, are of size 1 unit and 6.9% of the particles, by weight, are of size 5 units and 69.2% of the particles, by weight are of size 25 units) can theoretioally result in 85% of the space filled with particles after packing.

Another trimodal system having a size ratio of 1:7:49 and a mass ratio of 13.2:12.7:66.1 can result in 88% of the space filled with particles after packing. In yet another trimodal system having the same size ratio of 1:7:49 but a different mass ratio of 11:14:75 can result in 95% of the space filled with particles after packing. It will be appreciated that other particle size distributions may be utilized to obtain desired packing densities.

A bimodal system having a size ratio of 0.2:1 and a mass ratio of 30:70 (meaning that 30% of the particles, by weight, are of size0.2 units and 70% of the particles, by weight, are of size 1 unit) can theoretically result in 72% of the space filled with particles after packing. Another bimodal system having a size ratio of 0.15:1 and a mass ratio of 30:70 can result in 77% of the space filled with particles after packing.

The compressing of powdered hydraulic cement within the scope of the present invention is not to be confused with prior art processes which mold and shape cement pastes. As used herein, the term "cement paste" includes cement mixed with water such that the hydration reaction has commenced in the cement paste.

1. Pressure Compaction Processes

Pressure compaction processes, such as dry pressing and isostatic pressing, may be used to compress the powdered hydraulic cement around the nuclear waste according to the teachings of the present invention. Dry pressing consists of compacting powders between die faces in an enclosed cavity. Pressures can range from about 500 psi to greater than 100,000 psi in normal practice. Such pressures generally result in materials having void fractions between 2% and 50%, with a void fraction between about 5% and 30%, and a most preferred void fraction between about 5% and 30%, and a most preferred void fraction in the range from about 10% to about 25%.

In some cases, additives are mixed with the powdered hydraulic cement to make molding easier and to provide sufficient strength so that the article does not crumble upon removal from the press. Suitable additives preferably neither initiate hydration nor inhibit hydration of the hydraulic cement Grading the cement particles, as discussed above, may also provide a certain fluidity of the cement powder during compressing. In addition, it may be useful to lubricate the cement powder with an oil emulsion, according to techniques known in the art, to facilitate the lateral movement among the particles. Suitable emulsions may be prepared using nonaqueous, volatile solvents, such as acetone, methanol, and isopropyl alcohol.

Because cement particles are formed by crushing and grinding larger cement clinker pieces, the individual particles have rough edges. It has also been found that rounding the edges of the cement particles enhances their ability to slide over each other, thereby improving the packing efficiency of the cement particles. Techniques for rounding cement particles known in the art may be used.

Some of the air enclosed in the pores of the loose powder has to be displaced during pressing. The finer the mix and the higher the pressing rate, the more difficult the escape of air. The air may then remain compressed in the mix. Upon rapid release of the pressure, the pressed piece can be damaged by cracks approximately perpendicular to the direction of pressing. This pressure lamination, even though almost imperceptible, may weaken the resulting product. This problem is usually solved by repeated application of pressure or by releasing the pressure more slowly.

Isostatic pressing is another powder pressing technique in which pressure is exerted uniformly on all surfaces of the cement article. The method is particularly suitable in forming of symmetric shapes, and is similarly employed in the shaping of large articles which could not be pressed by other methods. In practice, the powdered mix is encased in a pliable rubber or polymer mold. The mold is then preferably sealed, evacuated to a pressure between 0.1 atm and 0.01 atm, placed in a high-pressure vessel, and gradually pressed to the desired pressure. An essentially noncompressible fluid such as high-pressure oil or water is preferably used. Pressures may range from 100 psi to 100,000 psi. The forming pressure is preferably gradually reduced before the part is removed from the mold. Vibrational compaction techniques, as described more fully in copending patent application Ser. No. 07/526,231, may be used to help pack the mix into the mold cavity. In vibrational compaction processes, the powdered hydraulic cement particles are typically compacted by low-amplitude vibrations. rticle friction is overcome by vibrations. Inter-particle friction is overcome by application of vibrational energy, causing the particles to pack to a density consistent with the geometric and material characteristics of the system and with the conditions of vibration imposed.

Packed densities as high as 100% of theoretical are possible using vibration packing processes. As used herein, the term "theoretical packing density" is defined as the highest conceivable packing density achievable with a given powder size distribution. Hence, the theoretical packing density is a function of the particle size distribution. Vibration packing processes may also be combined with pressure compaction processes to more rapidly obtain the desired packing densities or even higher packing densities.

Typical vibration frequencies may range from 1 Hz to 20,000 Hz, with frequencies from about 100 Hz to about 1000 Hz being preferred and frequencies from about 200 Hz to about 300 Hz being most preferred. Typical amplitudes may range from about one half the diameter of the largest cement particle to be packed to about 3 mm, with amplitudes in the range from about one half the diameter of the largest cement particle to about 1 mm. If the amplitude is too large, sufficient packing will not occur.

Once the amplitude is determined, the frequency may be varied as necessary to control the speed and rate of packing. For particle sizes in the range from 0.1 μm to 50 μm, the vibration amplitude is preferably in the range from about 10 μm to about 500 μm. Although it is not necessary to have a specific particle size distribution in order to successfully use vibrational compaction processes, carefully grading the particle size distribution usually improves compaction.

2. Aggregates and Composite Materials

It is within the scope of the present invention to include aggregates commonly used in the cement industry with the powdered hydraulic cement prior to hydration. Examples of such aggregates include sand, gravel, pumice, perlite, and vermiculite. One skilled in the art would know which aggregates to use to achieve desired characteristics in the final cementitious waste container.

For many uses it is preferable to include a plurality of differently sized aggregates capable of filling interstices between the aggregates and the powdered hydraulic cement so that greater density can be achieved. In such cases, the differently sized aggregates have particle sizes in the range from about 0.01 μm to about 2 cm.

In addition to conventional aggregates used in the cement industry, a wide variety of other fillers, fibers, and strengtheners, including balls, filings, pellets, powders, and fibers such as graphite, silica, alumina, fiberglass, polymeric fibers, and such other fibers typically used to prepare composites, may be combined with the powdered hydraulic cement prior to hydration. When the waste container is to be stored in a salt mine, salt may be included as an aggregate material with the powdered hydraulic cement to enhance the thermodynamic compatibility of the container with its storage environment. One overriding goal in developing suitable waste storage containers is to design a container which will be as thermodynamically compatible with the storage environment as possible so that the container will quickly reach thermodynamic equilibrium with its environment. For example, the more chemically compatible the storage container is to its storage environment, the closer the container is to thermodynamic equilibrium with its environment and the lower the driving force for chemical change.

3. Cement Hydration Techniques a. Cement Hvdration in General

The term hydration as used herein is intended to describe water. The chemistry of hydration is extremely complex and can only be approximated by studying the hydration of pure cement compounds. For simplicity in describing cement hydration, it is often assumed that the hydration of each compound takes place independently of the others that are present in the cement mixture. In reality, cement hydration involves complex interrelated reactions of the each compound int he cement mixture.

With respect to Portlaned cement, the principal cement components are dicalcium silicate and tricalcium silicate. Portland cement generally contains smaller amounts of tricalcium aluminate ($3CaO.Al_2O_3$) and tetracalcium aluminum ferrite ($4CaO.Al_2O_3.FeO$). The hydration reactions of the principal components of Portland cement are abbreviated as follows:

$$\underset{\text{tricalcium silicate}}{2C_3S} + \underset{\text{water}}{6H} \longrightarrow \underset{C-S-H}{C_3S_2H_2} + \underset{\text{calcium hydroxide}}{3CH}$$

$$\underset{\text{dicalcium silicate}}{2C_2S} + 4H \longrightarrow C_3S_2H_2 + CH$$

$$\underset{\text{tricalcium aluminate}}{C_3A} + 26H + \underset{\text{calcium sulfate hydrate}}{3C\bar{S}H_2} \longrightarrow \underset{\text{ettringite}}{C_6A\bar{S}_3H_{32}}$$

$$\underset{\text{ettringite}}{C_6A\bar{S}_3H_{32}} + 2C_3A + 4H \longrightarrow 3C_4A\bar{S}H_{12}$$

$$\underset{\text{tetracalcium aluminum ferrite}}{C_4AF} + 26H + 3C\bar{S}H_2 \longrightarrow C_6AF\bar{S}_3H_{32} + C$$

$$C_6AF\bar{S}_3H_{32} + 2C_3AF + 4H \longrightarrow 3C_4AF\bar{S}H_{12}$$

where dicalcium silicate is $2CaO.SiO_2$, tricalcium silicate is $3CaO.SiO_2$, calcium hydroxide is $Ca(OH)_2$, water is $H_2O$, $\bar{S}$ is sulfate, and C—S—H ("calcium silicate hydrate") is the principal hydration product. (The formula $C_2S_2H_2$ for calcium silicate hydrate is only approximate because the composition of this hydrate is actually variable over a wide range ($0.9<C:S<3.0$)). It is a poorly crystalline material which forms extremely small particles in the size of colloidal matter less than 0.1 μm in any dimension.) It will be appreciated that there are many other possible hydration reactions that occur with respect to other hydraulic cements and even with respect to Portland cement.

On first contact with water, C and S dissolve from the surface of each $C_3S$ grain, and the concentration of calcium and hydroxide ions rapidly increases. The pH rises to over 12 in a few minutes. The rate of this hydrolysis slows down quickly but continues throughout a dormant period. After several hours under normal conditions, the hydration products, CH and C—S—H, start to form rapidly, and the reaction again proceeds rapidly. Dicalcium silicate hydrates in a similar manner, but is much slower because it is a less reactive compound than $C_3S$. For additional information about the hydration reactions, reference is made to F. M. Lea, *Chemistry of Cement and Concrete,* 3rd edition, pp. 177-310 (1970).

It has been observed that the better the contact between individual cement particles both before and during hydration, the better the hydration product and the better the strength of the bond between the particles. Hence, the positioning of cement particles in close proximity one to another before and during hydration plays an important role in the strength and quality of the final cementitious waste container.

b. Hydration With Gaseous and Liquid Water

It is within the scope of the present invention to hydrate the powdered hydraulic cement after the cement particles have been compressed into a hazardous waste container. Hydration is accomplished without mechanical mixing of the cement and water. Thus, diffusion of water (both gaseous and liquid) into the compressed hazardous waste container is an important hydration technique within the scope of the present invention.

In most cases, hydration occurs immediately after the container is compressed. In other cases, initial hydration occur from water vapor in the atmosphere, with a more complete hydration occurring from ground water exposure after the container is placed in underground storage.

When hydration is achieved by contacting the cementitious waste container with gaseous water, the gas may be at atmospheric pressure; however, diffusion of the water into the article, and subsequent hydration, may be increased if the gaseous water is under pressure. The pressure may range from 0.001 torr to about 2000 torr, with pressures from about 0.1 torr to 1000 torr being preferred, and pressures from about 1 torr to about 50 torr being most preferred. Even though water vapor is introduced into the cement compact, it is possible that the water vapor may immediately condense into liquid water within the pores of the cement compact. If this happens, then gaseous water and liquid water may be functional equivalents.

Atomized liquid water may, in some cases, be used in place of gaseous water vapor. As used herein, atomized water is characterized by very small water droplets, whereas gaseous water is characterized by individual water molecules. Gaseous water is currently preferred over atomized water under most conditions because it can permeate the pore structure of the compressed cementitious container better than atomized water.

The temperature during hydration can affect the physical properties of the hydrated cement container. Therefore, it is important to be able to control and monitor the temperature during hydration. Cooling the cement container during hydration may be desirable to control the reaction rate.

The gaseous water may also be combined with a carrier gas. The carrier gas may be reactive, such as carbon dioxide or carbon monoxide, or the carrier gas may be inert, such as argon, helium, or nitrogen. Reactive carrier gases are useful in controlling the morphology and chemical composition of the final cementitious container. Reactive carrier gases may be used to treat the hazardous waste container before, during, and after hydration.

The partial pressure of the water vapor in the carrier gas may vary from about 0.001 torr to about 2000 torr, with 0.1 torr to about 1000 torr being preferred, and 1 torr to about 50 torr being most preferred. An autoclave may be conveniently used to control the gaseous environment during hydration. It is also possible to initially expose the cement container to water vapor for a period of time and then complete the hydration with liquid water. In addition, the cement container may be initially exposed to water vapor and then to carbon dioxide.

Heating the gaseous water will increase the rate of hydration. Temperatures may range from about 25° C. to about 200° C. It should be noted that the temperature at which hydration occurs affects certain physical characteristics of the final cement container, especially if an additional silica source is added. For example, when hydration temperature is greater than 50° C., the formation of a hydrogarnet crystalline phase is observed, and when the hydration temperature is greater than 85° C. other crystalline phases are observed.

These crystalline phases, which often weaken the cement structure, are not always desirable. However, in some cases, the pure crystalline phases may be desired. In order to form the pure crystalline phase, it is important to use pure starting materials and to accurately control the hydration temperature. It should be remembered that obtaining a container with high chemical and structural stability may be more important than obtaining mechanical strength when hydrating the powdered hydraulic cement.

c The Effect of Carbon Dioxide on Hydration

The inventors have found that when carbon dioxide is introduced during the stages of hydration, significant structural benefits can be realized, such as high strength and reduced shrinkage on drying. These concepts are disclosed in copending patent application Ser. No. 07/418,027, filed Oct. 10, 1989, entitled Process for Producing Improved Building Material and Product Thereof, which is incorporated herein by specific reference.

More specifically, as applied to the cementitious hazardous waste containers within the scope of the present invention, it has been found that $CO_2$ can be used to prepare cement containers having improved water resistance, surface toughness, and dimensional stability. These results may be obtained by exposing the cement container to an enriched $CO_2$ atmosphere while rapidly desiccating the cement container. For best results, the $CO_2$ is preferably at a partial pressure greater than its partial pressure in normal air.

d. Control of the Aqueous Solution

Aqueous solutions may also be used to hydrate the cementitious hazardous waste containers within the scope of the present invention. As used herein, the term aqueous solution refers to a water solvent having one or more solutes or ions dissolved therein which modify the hydration of hydraulic cement in a manner different than deionized water. For instance, it is possible to simply immerse the unhydrated cement container in lime water to achieve adequate hydration. Lime water is an aqueous solution containing $Ca^{2+}$ and $OH^-$ ions formed during the hydration reactions. Because of the presence of hydroxide ions, lime water typically has a pH in the range from about 9 to about 13.

Other aqueous solutions, such as extracts from cement paste, silica gel, or synthetic solutions may be used to hydrate the cement containers of the present invention. Other ions in addition to $Ca^{2+}$ and $OH^-$, such as carbonates, silica, sulfates, sodium, potassium, iron, and aluminum, may also be included in aqueous phase solutions. In addition, solutes such as sugars, polymers, water reducers, and superplasticizer may be used to prepare aqueous solutions within the scope of the present invention.

A typical aqueous solution within the scope of the present invention may contain one or more of the following components within the following ranges:

| Component | Concentration (ppm) | Most Preferred Concentration (ppm) |
|---|---|---|
| calcium | 50-3000 | 400-1500 |
| silicon | 0-25 | 0.25-5 |
| carbon | 0-5000 | 5-250 |
| iron | 0.001-10 | 0.01-0.2 |
| aluminum | 0.001-10 | 0.01-0.2 |
| sulfur | 0-5000 | 200-2000 |
| sodium | 0-2000 | 400-1500 |
| potassium | 0-4000 | 800-2000 |
| sugars | sdr | sdr |
| polymers | sdr | sdr |
| water reducers | sdr | sdr |
| superplasticizer | sdr | sdr |

Where the term "sdr" refers to the standard dosage rate in the concrete industry, and where the term "ppm" means the number of component atoms or molecules containing the component compound per million molecules of water. Apparatus capable of monitoring the concentrations of ions in the aqueous solution include pH meters and spectrometers which analyze absorbed and emitted light.

EXAMPLES

Various cementitious hazardous waste containers and their method of manufacture within the scope of the present invention will be further clarified by a consideration of the following examples, which are intended to be purely exemplary of the use of the invention and should not be viewed as a limitation on any claimed embodiment.

EXAMPLE 1

In this example, a hazardous waste container is prepared by isostatically compressing powdered hydraulic cement surrounding solid hazardous waste materials. The solid hazardous waste and the ordinary Portland cement are positioned within a pliable polymer mold such that from 5 to 10 inches of powdered cement surrounds the solid waste. The Portland cement also fills irregularities around the exterior surface of the solid hazardous waste materials. The container is then compressed at a pressure of 35,000 psi. After compression, the cement container has a green density of 2.6 g/cm$^3$.

The hazardous waste container is hydrated by immersing the container in saturated lime water having a pH of about 12 for about 24 hours. The saturated lime water is prepared by dissolving CaO in water. The lime water is maintained at a temperature between 22° C. and 25° C. at atmospheric pressure during hydration.

EXAMPLE 2

In this example a hazardous waste container is prepared according to the procedure of Example 1, except that a layer of powdered high alumina cement is positioned adjacent the solid hazardous waste and a layer of ordinary Portland cement is positioned around the high alumina cement prior to isostatic compression. The high alumina cement also fills irregularities around the exterior surface of the solid waste materials. The thickness of the high alumina cement layer is maintained between 2 to 8 inches, and the thickness of the Portland cement layer is maintained between 2 to 8 inches.

EXAMPLE 3

In this example a hazardous waste container is prepared according to the procedure of Example 1, except that the compressed cement container is hydrated by immersing the container in a 10% aqueous phase solution for about 24 hours. The 10% aqueous phase solution is prepared by making a cement paste having a 0.4 water to cement ratio and mixing the cement paste for 5 minutes. The aqueous phase is extracted from the paste and diluted with water to form the 10% aqueous phase solution.

EXAMPLE 4

In this example a hazardous waste container is prepared according to the procedure of Example 1, except that after isostatic compression, the hazardous waste container is hydrated by immersing the container in water for about 24.

EXAMPLE 5

In this example a hazardous waste container is prepared according to the procedure of Example 1, except that after isostatic compression, the hazardous waste container is hydrated by immersing the container in water for about 24 hours and thereafter exposing the hazardous waste container to $CO_2$ while in a desiccating environment.

EXAMPLE 6

In this example a hazardous waste container is prepared according to the procedure of Example 1, except that after isostatic compression, the hazardous waste container is carbonated under autoclaving conditions at 100% relative

EXAMPLE 7

In this example a hazardous waste container for high level nuclear waste is prepared according to the procedure of Example 1, except that the relative thickness of the cement compared to the quantity of waste materials is increased.

EXAMPLE 8

In this example, a hazardous waste container is prepared by isostatically compressing powdered hydraulic cement surrounding solid hazardous waste materials. The solid hazardous waste and ordinary Portland cement are positioned within a pliable polymer mold such that from 5 to 10 inches of powdered cement surrounds the solid waste. The Portland cement also fills irregularities around the exterior surface of the solid hazardous waste materials. The container is then compressed at a pressure of 35,000 psi. After compression, the cement container has a green density of 2.6 g/cm$^3$.

A layer of cement paste approximately 3 inches thick is then placed around the compressed waste container. Upon curing, the hazardous waste container includes an inner layer of substantially unhydrated cement compressed about and in contact with the hazardous waste and a hydrated cement outer layer.

EXAMPLE 9

In this example, a multi-layered hazardous waste container is prepared by isostatically compressing powdered hydraulic cement surrounding solid hazardous waste materials. The solid hazardous waste and high alumina cement are positioned within a pliable polymer mold such that from 5 to 10 inches of powdered cement surrounds the solid waste. The powdered cement also fills irregularities around the exterior surface of the solid hazardous waste materials. The container is then compressed at a pressure of 35,000 psi. After compression, the cement container has a green density of 2.6 g/cm$^3$.

The outer surface of the compressed high alumina cement is carbonated under autoclaving conditions at 100% relative humidity. An outer layer of Portland cement is then positioned around the compressed high alumina cement and compressed at a pressure of 35,000 psi as described above.

The outer layer of compressed Portland cement is hydrated by immersing the waste container in saturated lime water having a pH of about 12 for about 24 hours. The saturated lime water is prepared by dissolving CaO in water. The lime water is maintained at a temperature between 22° C. and 25° C. at atmospheric pressure during hydration.

The resulting hazardous waste container has a quantity of substantially unhydrated powdered hydraulic cement in contact with the solid hazardous waste material.

EXAMPLE 10

In this example, a multi-layered hazardous waste container is prepared according to the procedure of Example 9, except that the outer layer of Portland Cement also contains a plurality of fibers wrapped around the compressed high alumina cement to improve the mechanical properties of the final hazardous waste container.

EXAMPLE 11

In this example, a multi-layered hazardous waste container is prepared according to the procedure of Example 9, except that the outer layer of Portland Cement also contains electrical and thermal conducting aggregates dispersed therein to improve the mechanical properties of the final hazardous waste container.

SUMMARY

From the foregoing, it will be appreciated that the present invention provides novel containers for storing solid hazardous waste which are constructed of strong nonmetal materials which do not intrinsically corrode to produce a gas. The present invention also provides novel containers for storing solid hazardous waste which are $H_2O$ and $CO_2$ getters. In addition, the present invention provides novel containers for storing solid hazardous waste constructed of materials which expand upon contact with aqueous solution to inhibit further aqueous solution penetration into the container. Finally, it will be further appreciated that the present invention provides novel hazardous waste containers which are inexpensive.

The present invention may be embodied in other specific forms without departing from its spirit or essential charac teristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A method for preparing a hazardous waste container from a hydraulically bonded cement composition, the method comprising the steps of:
   (a) compressing a powdered hydraulic cement composition around a quantity of solid hazardous waste; and
   (b) hydrating the powdered hydraulic cement without substantial mechanical mixing of the cement and water such that a portion of the powdered hydraulic cement in contact with the solid hazardous waste remains substantially unhydrated.

2. A method for preparing a hazardous waste container as defined in claim 1, wherein the powdered hydraulic cement is hydrated by contacting the powdered hydraulic cement with gaseous water.

3. A method for preparing a hazardous waste container as defined in claim 1, wherein the powdered hydraulic cement is hydrated in an environment having a relative humidity in the range from about 25% to about 100%.

4. A method for preparing a hazardous waste container as defined in claim 1, wherein the powdered hydraulic cement is hydrated in a controlled gaseous environment including carbon dioxide.

5. A method for preparing a hazardous waste container as defined in claim 1, wherein the powdered hydraulic cement is hydrated in a controlled gaseous environment including carbon monoxide.

6. A method for preparing a hazardous waste container as defined in claim 1, wherein the powdered hydraulic cement is hydrated in a partial vacuum environment.

7. A method for preparing a hazardous waste container as defined in claim 1, wherein the powdered hydraulic cement is hydrated by contacting the powdered hydraulic cement with atomized liquid water.

8. A method for preparing a hazardous waste container as defined in claim 1, wherein the powdered hydraulic cement is hydrated by contacting the powdered hydraulic cement with an aqueous solution.

9. A method for preparing a hazardous waste container as defined in claim 8, wherein the aqueous solution has a pH in the range from about 7 to about 14.

10. A method for preparing a hazardous waste container as defined in claim 8, wherein the aqueous solution has a pH in the range from about 9 to about 13.5.

11. A method for preparing a hazardous waste container as defined in claim 8, wherein the aqueous solution includes calcium as a component.

12. A method for preparing a hazardous waste container as defined in claim 8, wherein the aqueous solution includes carbon as a component.

13. A method for preparing a hazardous waste container as defined in claim 8, wherein the aqueous solution includes sulfur as a component.

14. A method for preparing a hazardous waste container as defined in claim 8, wherein the aqueous solution includes sodium as a component.

15. A method for preparing a hazardous waste container as defined in claim 8, wherein the aqueous solution includes potassium as a component.

16. A method for preparing a hazardous waste container as defined in claim 8, wherein the aqueous solution includes a sugar as a component.

17. A method for preparing a hazardous waste container as defined in claim 8, wherein the aqueous solution includes a water reducer as a component.

18. A method for preparing a hazardous waste container as defined in claim 8, wherein the aqueous solution includes a superplasticizer as a component.

19. A method for preparing a hazardous waste container as defined in claim 1, wherein the powdered hydraulic cement is hydrated in an environment having a temperature in the range from about −10° C. to about 200° C.

20. A method for preparing a hazardous waste container as defined in claim 1, wherein the powdered hydraulic cement has a predetermined polymodal size distribution.

21. A method for preparing a hazardous waste container as defined in claim 1, wherein individual cement particles of the powdered hydraulic cement are rounded to improve packing efficiency.

22. A method for preparing a hazardous waste container as defined in claim 1, further comprising an aggregate mixed with the powdered hydraulic cement prior to hydrating the cement.

23. A method for preparing a hazardous waste container as defined in claim 22, wherein the aggregate comprises a plurality of aggregate particles having a predetermined polymodal size distribution.

24. A method for preparing a hazardous waste container as defined in claim 22, wherein the aggregate comprises a plurality of differently sized aggregates having particle sizes in the range from about 0.01 μm to about 3 cm.

25. A method for preparing a hazardous waste container as defined in claim 22, wherein the aggregate comprises a plurality of differently sized aggregates having particle sizes in the range from about 1 μm to about 1 cm.

26. A method for preparing a hazardous waste container as defined in claim 22, wherein the aggregate includes a plurality of fibers.

27. A method for preparing a hazardous waste container as defined in claim 1, wherein the powdered hydraulic cement is compressed into the mold using an isostatic press.

28. A method for preparing a hazardous waste container as defined in claim 27, wherein the powdered hydraulic cement is compressed into the mold under a pressure in the range from about 100 psi to about 100,000 psi.

29. A method for preparing a hazardous waste container as defined in claim 1, wherein the powdered hydraulic cement includes a mixture of chemically different hydraulic cements.

30. A method for preparing a hazardous waste container as defined in claim 1, wherein the powdered hydraulic cement includes a Portland cement.

31. A method for preparing a hazardous waste container as defined in claim 1, wherein the powdered hydraulic cement includes a calcium aluminate cement.

32. A method for preparing a hazardous waste container as defined in claim 1, wherein the powdered hydraulic cement includes dicalcium silicate.

33. A method for preparing a hazardous waste container as defined in claim 1, wherein the powdered hydraulic cement includes tricalcium silicate.

34. A method for preparing a hazardous waste container as defined in claim 1, wherein the powdered hydraulic cement includes a phosphate cement.

35. A method for preparing a hazardous waste container as defined in claim 1, further comprising the step of exposing the powdered hydraulic cement composite article to carbon dioxide in a desiccating environment.

36. A method for preparing a hazardous waste container as defined in claim 1, further comprising the step of exposing the powdered hydraulic cement composite article to carbon monoxide in a desiccating environment.

37. A method for preparing a hazardous waste container as defined in claim 1, wherein the solid hazardous waste includes a steel waste container.

38. A method for preparing a hazardous waste container as defined in claim 1, wherein the solid hazardous waste includes a radioactive waste.

39. A method for preparing a hazardous waste container as defined in claim 1, wherein the solid hazardous waste includes a semisolid waste material.

40. A method for preparing a hazardous waste container comprising the steps of:

(a) positioning an inner layer of powdered hydraulic cement around a quantity of solid hazardous waste;
(b) positioning a outer layer of powdered hydraulic cement around said inner layer of powdered hydraulic cement;
(c) compressing said powdered hydraulic cement layers around the solid hazardous waste; and
(d) hydrating the outer layer of powdered hydraulic cement without substantial mechanical mixing of the cement and water such that a portion of the powdered hydraulic cement in contact with the solid hazardous waste remains substantially unhydrated.

41. A method for preparing a hazardous waste container comprising the steps of:
(a) positioning an inner layer of powdered hydraulic cement around a quantity of solid hazardous waste;
(b) compressing the inner layer of powdered hydraulic cement around the solid hazardous waste at a pressure in the range from about 100 psi to about 100,000 psi;
(c) positioning an outer layer of cement paste around the compressed inner layer of powdered hydraulic cement; and
(d) hydrating and curing the outer layer of cement paste without substantial hydration of the compressed inner layer of powdered hydraulic cement.

42. A cementitious hazardous waste container prepared by the process comprising the steps of:
(a) compressing a powdered hydraulic cement composition around a quantity of solid hazardous waste; and
(b) hydrating the powdered hydraulic cement without substantial mechanical mixing of the cement and water such that a portion of the powdered hydraulic cement in contact with the solid hazardous waste remains substantially unhydrated.

43. A cementitious hazardous waste container prepared by the process as defined in claim 42, wherein the powdered hydraulic cement is hydrated by contacting the powdered hydraulic cement with gaseous water.

44. A cementitious hazardous waste container prepared by the process as defined in claim 42, wherein the powdered hydraulic cement is hydrated in a controlled gaseous environment including carbon dioxide.

45. A cementitious hazardous waste container prepared by the process as defined in claim 42, wherein the powdered hydraulic cement is hydrated by contacting the powdered hydraulic cement with an aqueous solution.

46. A cementitious hazardous waste container prepared by the process as defined in claim 42, wherein the powdered hydraulic cement has a predetermined polymodal size distribution.

47. A cementitious hazardous waste container prepared by the process as defined in claim 42, further comprising an aggregate mixed with the powdered hydraulic cement prior to hydrating the cement.

48. A cementitious hazardous waste container prepared by the process as defined in claim 42, wherein the powdered hydraulic cement is compressed into a mold using an isostatic press.

49. A cementitious hazardous waste container prepared by the process as defined in claim 42, further comprising the step of exposing the powdered hydraulic cement composite article to carbon dioxide in a desiccating environment.

50. A cementitious hazardous waste container prepared by the process as defined in claim 42, wherein the solid hazardous waste includes a steel waste container.

51. A cementitious hazardous waste container comprising:
an inner layer of substantially unhydrated, powdered hydraulic cement in contact with a quantity of solid hazardous waste, said powdered hydraulic cement being compressed about said solid hazardous waste to a pressure in the range from about 100 psi to about 100,000 psi; and
an outer layer of hydrated cement surrounding, and in contact with, the inner layer.

52. A cementitious hazardous waste container as defined in claim 51, wherein the outer layer of hydrated cement has an average thickness in the range from about 0.25 inches to about 3 inches.

53. A hazardous waste container comprising:
a quantity of hazardous waste; and
means for encapsulating the hazardous waste, said encapsulating means being compressed about the solid hazardous waste and having noncorrosive, $H_2O$ getter, and $CO_2$ getter characteristics, said encapsulating means including substantially hydrated cement about an outer periphery of the encapsulating means and substantially unhydrated cement adjacent the hazardous waste, wherein the degree of cement hydration decreases from the substantially hydrated outer periphery of the encapsulating means toward the interior of the encapsulating means.

54. A hazardous waste container as defined in claim 53, wherein said encapsulating means is capable of expanding upon reaction with water.

55. A hazardous waste container as defined in claim 53, wherein the quantity of hazardous waste includes nuclear waste.

56. A hazardous waste container as defined in claim 53, wherein the quantity of hazardous waste is semisolid.

57. A method for containing solid hazardous waste comprising the steps of:
(a) obtaining a quantity of solid hazardous waste;
(b) compressing a powdered hydraulic cement composition around the solid hazardous waste; and
(c) hydrating the powdered hydraulic cement without substantial mechanical mixing of the cement and water such that a portion of the powdered hydraulic cement in contact with the solid hazardous waste remains substantially unhydrated.

58. A method for containing solid hazardous waste as defined in claim 57, wherein the solid hazardous waste includes nuclear waste.

* * * * *

UNITED STATES PATENT AND TRADEMARK OFFICE

CERTIFICATE OF CORRECTION

PATENT NO. : 5,100,586

DATED : March 31, 1992

INVENTOR(S) : HAMLIN M. JENNINGS et al.

It is certified that error appears in the above-identified patent and that said Letters Patent is hereby corrected as shown below:

Column 1, line 21, "longterm" should be --long-term--
Column 1, line 28, after "by" insert --emitting alpha particles. Alpha particles do not even--
Column 1, line 53, after "possible" insert --.--
Column 1, line 57, after "is" insert --that they often contain a lot of empty space inside the drums.--
Column 1, line 68, "$H_2$" should be --$H_2O$--
Column 7, lines 42-43, delete "rticle friction is overcome by vibrations."
Column 8, line 51, "Hvdration" should be --Hydration--
Column 8, line 53, after "describe" insert --the chemical reactions that take place between the cement and--
Column 8, line 61, "Portlaned" should be --Portland--
Column 12, line 68, "24" should be --24 hours--
Column 17, line 3, "a" should be --an--

Signed and Sealed this

Twelfth Day of October, 1993

*Attest:*

*Attesting Officer*

Bruce Lehman

BRUCE LEHMAN

*Commissioner of Patents and Trademarks*